US010451077B2

(12) United States Patent
Maier et al.

(10) Patent No.: US 10,451,077 B2
(45) Date of Patent: Oct. 22, 2019

(54) AXIAL FAN

(75) Inventors: Erich Maier, Würzburg (DE); Paul McLennan, London (CA); Robert Jones, London (CA)

(73) Assignee: MAGNA POWERTRAIN BAD HOMBURG GMBH, Bad Homubrg (DE)

( * ) Notice: Subject to any disclaimer, the term of this patent is extended or adjusted under 35 U.S.C. 154(b) by 1742 days.

(21) Appl. No.: 13/503,414

(22) PCT Filed: Oct. 21, 2010

(86) PCT No.: PCT/DE2010/001221

§ 371 (c)(1),
(2), (4) Date: May 15, 2012

(87) PCT Pub. No.: WO2011/047665

PCT Pub. Date: Apr. 28, 2011

(65) Prior Publication Data

US 2012/0224988 A1 Sep. 6, 2012

(30) Foreign Application Priority Data

Oct. 22, 2009 (DE) ..... 10 2009 050 369

(51) Int. Cl.

| | |
|---|---|
| ***F04D 25/08*** | (2006.01) |
| ***F04D 29/32*** | (2006.01) |
| ***F04D 29/64*** | (2006.01) |
| *F01P 5/04* | (2006.01) |

(52) U.S. Cl.

CPC ..... *F04D 25/08* (2013.01); *F04D 29/329* (2013.01); *F04D 29/646* (2013.01); *F01P 2005/046* (2013.01)

(58) Field of Classification Search

CPC .. F04D 19/002; F04D 25/0613; F04D 25/064; F04D 25/06; F04D 29/329; F04D 29/646; F01P 2005/046

USPC ..... 417/352, 353, 354, 423.14; 415/213.1, 415/124.1, 119; 416/244 R, 500

See application file for complete search history.

(56) References Cited

U.S. PATENT DOCUMENTS

| | | | | |
|---|---|---|---|---|
| 4,130,770 | A * | 12/1978 | Wrobel | 310/67 R |
| 5,399,070 | A * | 3/1995 | Alizaden | 416/189 |
| 5,944,497 | A * | 8/1999 | Kershaw et al. | 417/423.8 |
| 6,360,703 | B1 * | 3/2002 | Rahbar et al. | 123/41.49 |
| 6,908,284 | B2 * | 6/2005 | Adrian | 416/134 R |
| 7,442,010 | B2 * | 10/2008 | Gruber et al. | 416/169 A |
| 8,672,615 | B2 * | 3/2014 | Ruckert et al. | 415/121.2 |
| 2007/0024135 | A1 * | 2/2007 | Simofi-Ilyes et al. | 310/89 |
| 2008/0085188 | A1 * | 4/2008 | Hanlon | 415/220 |
| 2008/0131274 | A1 * | 6/2008 | Kim et al. | 415/204 |

* cited by examiner

*Primary Examiner* — Charles G Freay
*Assistant Examiner* — Lilya Pekarskaya
(74) *Attorney, Agent, or Firm* — Jordan IP Law, LLC; Todd A. Vaughn

(57) ABSTRACT

An axial fan with an electric motor, on the rotor of which a an wheel is mounted, the rotor having a portion with a cylindrically pot-shaped configuration, onto which the wheel is pushed with a completely or partially cylindrical part so as to fit, and the fan wheel lying completely behind the plane predetermined by the bottom surface of the rotor.

17 Claims, 4 Drawing Sheets

AXIAL FAN

CROSS-REFERENCE TO RELATED APPLICATIONS

The present application is a National Stage Application of PCT International Application No. PCT/DE2010/001221 (filed on Oct. 21, 2010), under 35 U.S.C. § 371, which claims priority to German Patent Application No. 10 2009 050 369.2 (filed on Oct. 22, 2009), which are each hereby incorporated by reference in their respective entireties

FIELD OF THE INVENTION

The present invention relates to an axial fan and, in particular, to an axial fan for a radiator module of a motor vehicle.

BACKGROUND OF THE INVENTION

A customary axial fan for a radiator module of a motor vehicle is shown in the document EP 1 892 421 A2. This axial fan is equipped with a hub for connecting the fan wheel to an electric drive motor, said hub being of essentially pot-shaped design and having an end region and an essentially cylindrical circumferential region. The innovation proposed is that the connection be designed to be torsionally flexible. However, the customary axial fan still has the disadvantage of a relatively large overall length. This is contrary to the demand for increasingly flatter radiator modules.

SUMMARY OF THE INVENTION

The present invention, therefore, has the set object of providing an axial fan for an especially flat radiator module and, to achieve this, proposes an axial fan having an electric motor with a rotor and a fan wheel mounted thereon, the rotor having a cylindrical pot-shaped configuration, onto which the fan wheel is pushed with a completely or partially cylindrical part so as to fit, wherein the fan wheel lies completely behind the plane predetermined by the bottom surface of the rotor.

Advantageous refinements and developments of the axial fan according to the invention are specified in the following description.

BRIEF DESCRIPTION OF THE DRAWINGS

The invention is described below by means of exemplary embodiments illustrated in the drawings in which show.

DETAILED DESCRIPTION OF EMBODIMENTS

Figure 1:
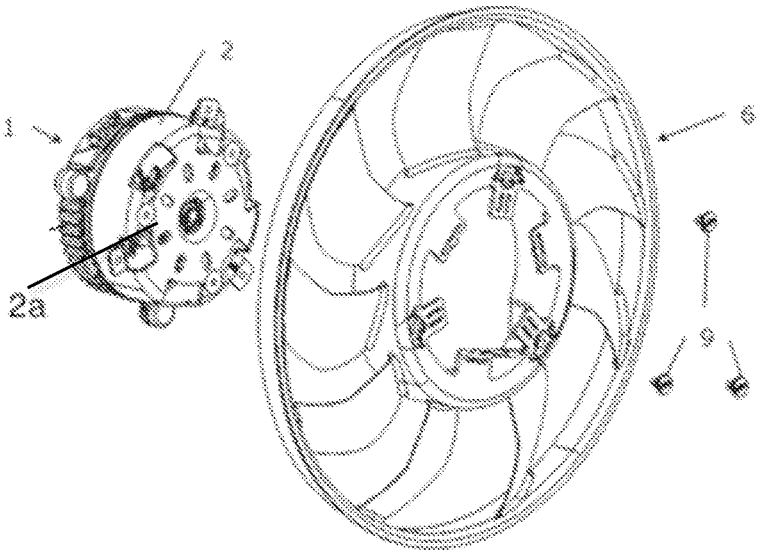
FIG. 1 illustrates a diagrammatically simplified perspective exploded view of a first axial fan in accordance with the invention for a motor vehicle from the front side.
Figure 2:
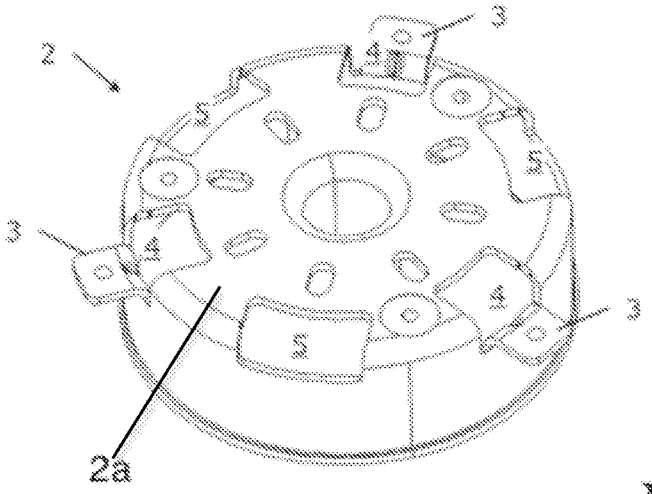
FIG. 2 illustrates a perspective top view of the rotor of the electric motor in the first axial fan of FIG. 1 from the front side.
Figure 3:
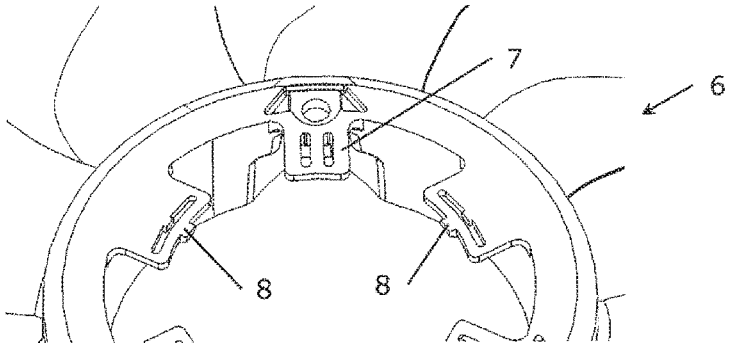
FIG. 3 illustrates a diagrammatically simplified perspective partial top view of the fan wheel in the first axial fan of FIG. 1 from the front side.

As illustrated in FIGS. 1 to 3, a first embodiment of an axial fan in accordance with the invention comprises an electric motor 1 with a rigidly coupled fan wheel 6. For this purpose, the fan wheel 6 is firmly connected to the rotor 2 of the electric motor 1. Various tabs of the fan wheel 6, a plurality of holding tongues 3 of the rotor 2, various clearances 4, 5 in the rotor 2 and a number of fastening screws 9 contribute to this connection in the way described in detail below.

As illustrated in the exploded illustration of FIG. 1, the fan wheel 6 has a cylindrically designed inner region which is intended for receiving the cylindrically pot-shaped rotor 2 of the electric motor 1. By means of a suitably close fit between the cylindrical surfaces on the rotor 2 and on the fan wheel 6, the fan wheel 6 is oriented centrically in relation to the motor shaft and so as to be tilt-proof. Furthermore, the fan wheel 6 bears in the axial direction against the plurality of holding tongues 3 distributed on the circumference of the rotor 2. The respective contact surfaces preferably lie in a plane which runs perpendicularly to the axis of rotation and which is set back behind the surface of the bottom region 2*a* of the rotor 2. An arrangement is thereby possible in which no parts of the fan wheel 6 lie in front of the plane predetermined by the bottom region 2*a* of the rotor 2. This is a necessary precondition for an especially short overall length of the axial fan.

A number of slotted cover tabs 7 on the fan wheel 6 are provided for covering the clearances 4 caused by the production method, in addition to the holding tongues 3, and for preventing the ingress of foreign bodies into the interior of the electric motor 1. Furthermore, a number of strong driving tabs 8 are provided in the fan wheel 6. These driving tabs 8 engage into a number of second recesses 5 in the rotor 2. This prevents the fan wheel 6 from twisting in relation to the rotor 2, An unwanted release of the fan wheel 6 from the rotor 2 is avoided by means of three fastening screws 9. These fastening screws 9 are preferably arranged within the contact surfaces between the holding tabs 3 and the fan wheel 6, as illustrated in the drawings.

Figure 4:
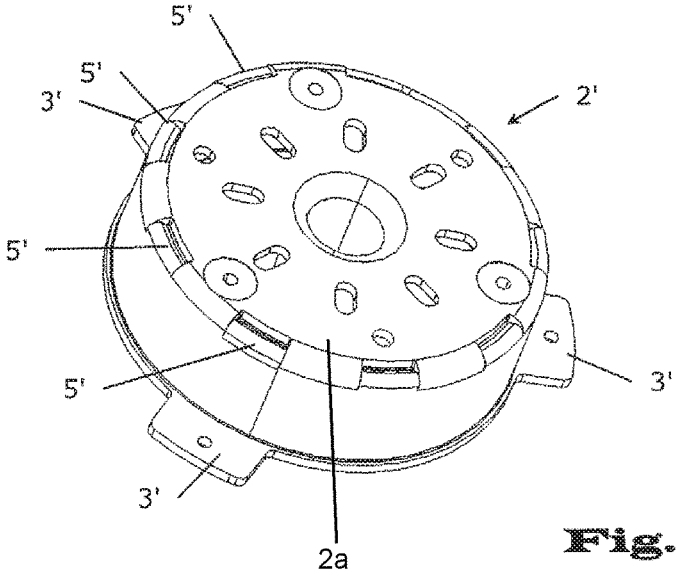
FIG. 4 illustrates a diagrammatically simplified perspective partial top view of an alternatively configured fan wheel of a second axial fan from the front side.
Figure 5:
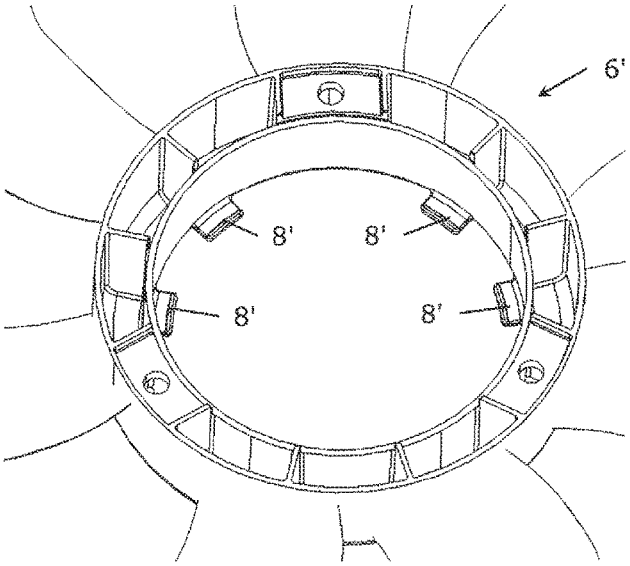
FIG. 5 illustrates a diagrammatically simplified perspective partial top view of an alternative fan wheel of a second axial fan from the rear side.

As illustrated in FIGS. 4 and 5, in an alternative second embodiment of an axial fan in accordance with the invention, the holding tongues 3' are arranged in the region of the margin of the rotor 2'. The matching bearing surfaces are located correspondingly on the underside of the fan wheel 6'. The first recesses 4 caused by the production method in the first embodiment are omitted here. There is also correspondingly no need to provide any covering tabs. The transfer of torque is brought about by a larger number of smaller driving tabs 8' which engage into sunken recesses at the margin of the bottom region or surface 2*a* of the rotor 2'.

As can be seen, both above-described embodiments of an axial fan in accordance with the invention likewise afford the advantageous and cost-effective possibility of producing the rotor 2 of the electric motor 1 from a sheet metal blank by means of a simple pressing or drawing method. In the first preferred embodiment, the holding tongues 3 can be provided by means of C-shaped cuts which run in the bottom region 2*a* and the inside of which is folded round outward. In the second embodiment, the holding tongues 3 of the rotor 2 are formed by a collar region which is partially cut out.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

LIST OF REFERENCE SYMBOLS

Electric motor 1
Rotor 2
Holding tongues 3
Recesses, first 4
Recesses, second 5
Fan wheel 6
Cover tabs 7
Driving tabs 8
Fastening screws 9

What is claimed is:

1. An axial fan comprising:

an electric motor having a rotor with a plurality of holding tongues which project outwardly from an outer circumference of the rotor in a plane extending perpendicularly to the axis of the electric motor; and a fan wheel having an inner peripheral region to be engaged by the holding tongues and mount the fan wheel to the electric motor in a manner such that the fan wheel lies completely behind a plane predetermined by a bottom surface of the rotor.

2. The axial fan of claim 1, wherein the holding tongues are spatially positioned behind the bottom surface of the rotor.

3. The axial fan of claim 1, wherein the holding tongues are spatially positioned a distance behind the bottom surface of the rotor.

4. The axial fan of claim 1, wherein the rotor includes:

a plurality of first recesses at a front surface thereof; and a plurality of second recesses at a front surface thereof.

5. The axial fan of claim 4, wherein the fan wheel includes:

a plurality of first tabs extending from the inner peripheral region thereof, each one of the first tabs configured for receipt in and engaging a corresponding one of the first recesses; and a plurality of second tabs extending from the inner peripheral region thereof, each one of the second tabs provided spatially above a corresponding one of the second recesses.

6. The axial fan of claim 5, wherein the torque of the electric motor is transferred from the first recesses to the first tabs during operation of the electric motor.

7. An axial fan comprising:

an electric motor having a rotor with a plurality of first recesses at a front surface of the rotor and a plurality of holding tongues which project outwardly from the front, outer circumferential surface thereof in a plane extending perpendicularly to the axis of the electric motor; and a fan wheel having an inner peripheral region to receive the rotor and mount the fan wheel to the electric motor in a manner such that the fan wheel lies completely behind a plane predetermined by a bottom surface of the rotor, the fan wheel including a plurality of first tabs extending from the inner peripheral region thereof, each one of the first tabs for receipt in and engaging a corresponding one of the first recesses when the fan wheel is mounted to the electric motor.

8. The axial fan of claim 7, wherein the holding tongues are spatially positioned behind the bottom surface of the rotor.

9. The axial fan of claim 7, wherein the holding tongues are spatially positioned a distance behind the bottom surface of the rotor.

10. The axial fan of claim 7, wherein the holding tongues are for engaging the inner peripheral region of the fan wheel to thereby mount the fan wheel to the electric motor.

11. The axial fan of claim 7, wherein the rotor includes a plurality of second recesses at a front surface thereof.

12. The axial fan of claim 11, wherein the fan wheel includes a plurality of second tabs extending from the inner peripheral region thereof, each one of the second tabs provided spatially above a corresponding one of the second recesses.

13. The axial fan of claim 12, wherein the torque of the electric motor is transferred from the first recesses to the first tabs during operation of the electric motor.

14. The axial fan of claim 7, wherein the fan wheel is connected to the rotor by mechanical connection at the holding tongues.

15. An axial fan comprising:

an electric motor having a rotor with a plurality of holding tongues which project outwardly from the front outer circumferential surface of the rotor in a plane extending perpendicularly to the axis of the electric motor, a plurality of first recesses at the front surface of the rotor, and a plurality of second recesses at the front surface; and a fan wheel having an inner peripheral region configured to receive the rotor in a manner such that the fan wheel lies completely behind a plane predetermined by the bottom surface of the rotor, the fan wheel including a plurality of first tabs extending from the inner peripheral region thereof, each one of the first tabs configured for receipt in and engaging a corresponding one of the first recesses when the fan wheel is mounted to the electric motor, and a plurality of second tabs extending from the inner peripheral region thereof, each one of the second tabs provided spatially above a corresponding one of the second recesses.

16. The axial fan of claim 15, wherein the fan wheel is connected to the rotor by mechanical connection at the holding tongues.

17. The axial fan of claim 15, wherein the holding tongues are spatially positioned behind the bottom surface of the rotor.

* * * * *